United States Patent [19]

Lyons et al.

[11] 3,931,967

[45] Jan. 13, 1976

[54] RACKET COVER AND SUPPORT PRESS

[76] Inventors: Dianne D. Lyons, Pelican Rock on Cotton Valley Shores, Christiansted, St. Croix, V.I. 00820; William R. Chandler, 57A Salt River, Christiansted, St. Croix, V.I.

[22] Filed: Oct. 7, 1974

[21] Appl. No.: 512,728

[52] U.S. Cl. ..... 273/74

[51] Int. Cl.[2] ..... A63B 49/16; A63B 49/18

[58] Field of Search..... 273/74; 220/283, 333–343

[56] References Cited

UNITED STATES PATENTS

| | | | |
|---|---|---|---|
| 1,925,330 | 9/1933 | Leisner | 273/74 |
| 1,989,577 | 1/1935 | Watkins | 273/74 |
| 2,088,107 | 7/1937 | Hassenfeld | 220/337 |
| 2,196,625 | 4/1940 | Clowson | 273/74 |
| 3,317,076 | 5/1967 | Enders | 220/337 |
| 3,343,838 | 9/1967 | Bauknecy | 273/74 |
| 3,402,931 | 9/1968 | Maxon | 273/74 |
| 3,604,706 | 9/1971 | Bauknecy | 273/74 |
| 3,670,875 | 6/1972 | Jones | 220/334 X |

FOREIGN PATENTS OR APPLICATIONS

| | | | |
|---|---|---|---|
| 1,294,904 | 4/1962 | France | 273/74 |
| 12,471 | 6/1905 | United Kingdom | 273/74 |

*Primary Examiner*—Richard J. Apley

*Attorney, Agent, or Firm*—Smith, Harding, Earley & Follmer

[57] ABSTRACT

A combined tennis racket cover and support press including a case made of stiff material such as plastic and adapted to receive a tennis racket head, which case includes a bottom frame portion hingedly connected to two top half-frame portions which may be opened to receive the head of a tennis racket and closed and locked against springs urging open the top half-frame portions. The case provides a stiff enclosure to protect the racket against physical damage and contains pressure pads for applying pressure onto the head of the racket to prevent warpage.

5 Claims, 5 Drawing Figures

RACKET COVER AND SUPPORT PRESS

BACKGROUND OF THE INVENTION

Tennis rackets require care in order to achieve their maximum useful life. They are subject to being damaged when they are transported by the owner either on a short trip to a tennis court or on a longer vacation trip. Also, they can become damaged or warped during storage.

At present, when a tennis player is traveling, either locally or on a long trip, the racket is usually covered with the fabric or plastic cover and hand-carried, or put into an accessory bag with other tennis items and either hand-carried or carried by means of a shoulder strap. When the racket is stored, it is usually hung on a hook by a loop on the racket cover or simply leaned against a wall in a closet or on a shelf. The cover for the racket is usually a fabric bag of some sort or a plastic bag with a side zipper. Some tennis players apply a conventional wooden press to the racket head. The press fits over the fabric or plastic cover and applies pressure at four points by the use of four wing nuts or screws or similar means.

When a racket is transported by a car, it is usually put in a safe place to prevent the puncturing of the cover and the breakage of strings which might occur in the event that the car should stop suddenly. When carried on an airplane, the racket is often placed under the seat where someone's foot could puncture the cover and break the strings. The shape of the racket makes it difficult to handle and protect while traveling.

The conventional wooden racket press is seldom used while traveling in either a car or an airplane because it adds bulk and weight to an already awkward item. Moreover, the metal parts of the press extend outwardly and are dangerous in that they can easily tear clothing, particularly stockings, and can snag on almost any item that comes into contact with them. Thus, the wooden press is usually used only for storage purposes.

Neither the wooden presses or the vinyl or fabric covers in use today offer protection from punctures, and ripping of the strings of the racket.

The prior art has not provided any satisfactory solution to the above-discussed problem of protecting a tennis racket both during travel and in storage. Illustrative of the prior art are the devices disclosed in U.S. Pat. Nos. 1,027,786; 1,197,332; 2,180,783; 2,196,625; 2,750,190; 3,604,706; and 3,343,838.

The racket case and press shown in U.S. Pat. No. 1,027,786 requires an elaborate structure with exposed screw fastenings that may catch on things in transit, and requires screwing the apparatus between the strings of the racket which may damage the strings. Moreover, the screws can be misplaced.

The design shown in U.S. Pat. No. 1,197,332 requires fastenings that go between the strings of the racket, and it does not adequately protect the racket from weather.

The racket press shown in U.S. Pat. No. 2,180,783 provides no protection against weather and requires a cover in addition to the use of a press.

The device shown in U.S. Pat. No. 2,196,625 serves primarily as a frame and press and offers no weather or cover protection.

The racket press shown in U.S. Pat. No. 2,750,190 requires the use of a separate cover for portable use and during bad weather conditions.

The racket press and cover shown in each of the U.S. Pat. Nos. 3,343,838 and 3,604,706 is complicated and elaborate construction and would be expensive.

SUMMARY OF THE INVENTION

It is the general object of the invention to provide a combined tennis racket cover and support press which presses the tennis racket while it is contained in a case and at the same time protects it from inclement weather and against the danger of string breakage, especially during traveling. Moreover, these desirable features are achieved by a device which is made of a single unit which is opened and used easily without requiring loose and unnecessary parts, such as screws that can be lost. The application of the pressing is accomplished simply by closing the case and no elaborate effort is required to apply pressure at points to prevent warping of the racket. Moreover, the equalization of the pressure points is achieved simply and easily. The design in accordance with the invention eliminates the elaborate structure of wooden frames, plates, clamps and screws used in the prior art. Moreover, the smooth design of the combination case-press-protector enables it to be used for storage or during transport and it can be carried by hand or within another bag or accessory case. The design is light in weight and does not involve any protruding parts.

DESCRIPTION OF THE PREFERRED EMBODIMENT

Figure 4:
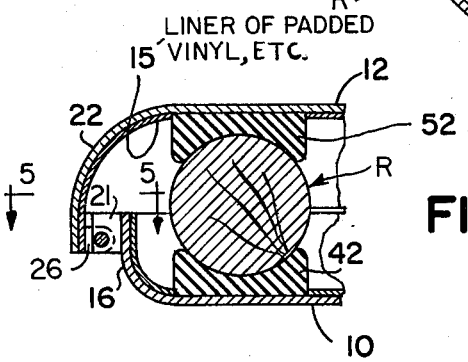
FIG. 4 is a fragmentary sectional view along section line 4—4 of FIG. 3 of a detail of the invention.
Figure 1:
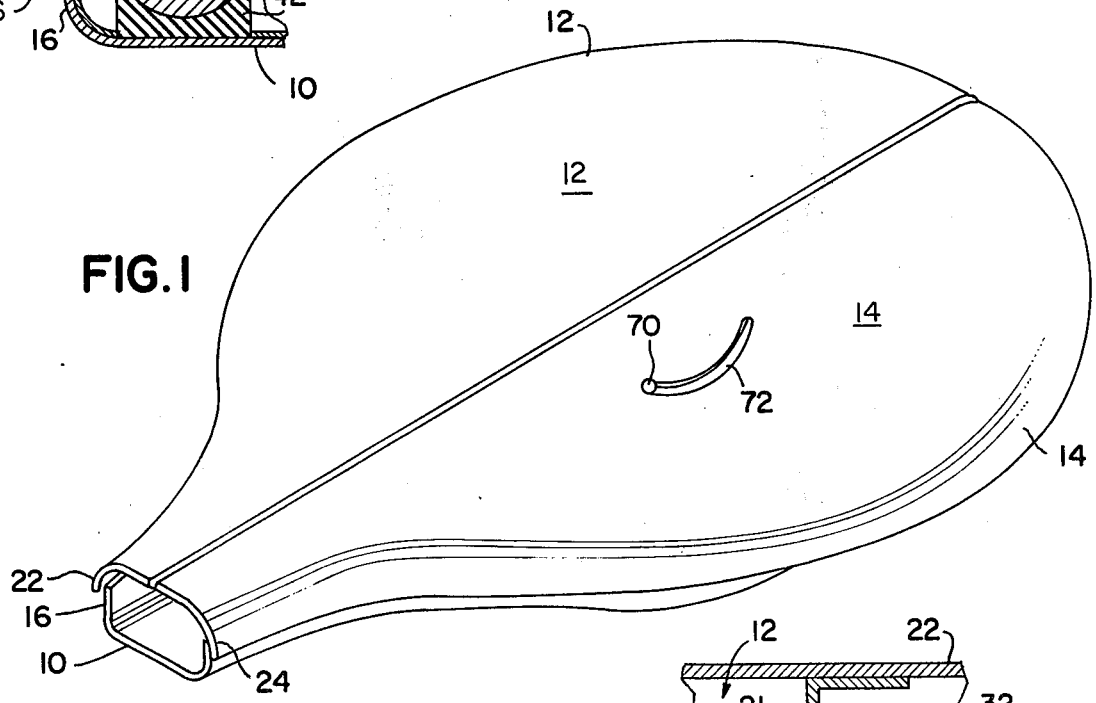
FIG. 1 is a perspective view of a tennis racket case and press in accordance with this invention in a closed position.
Figure 2:
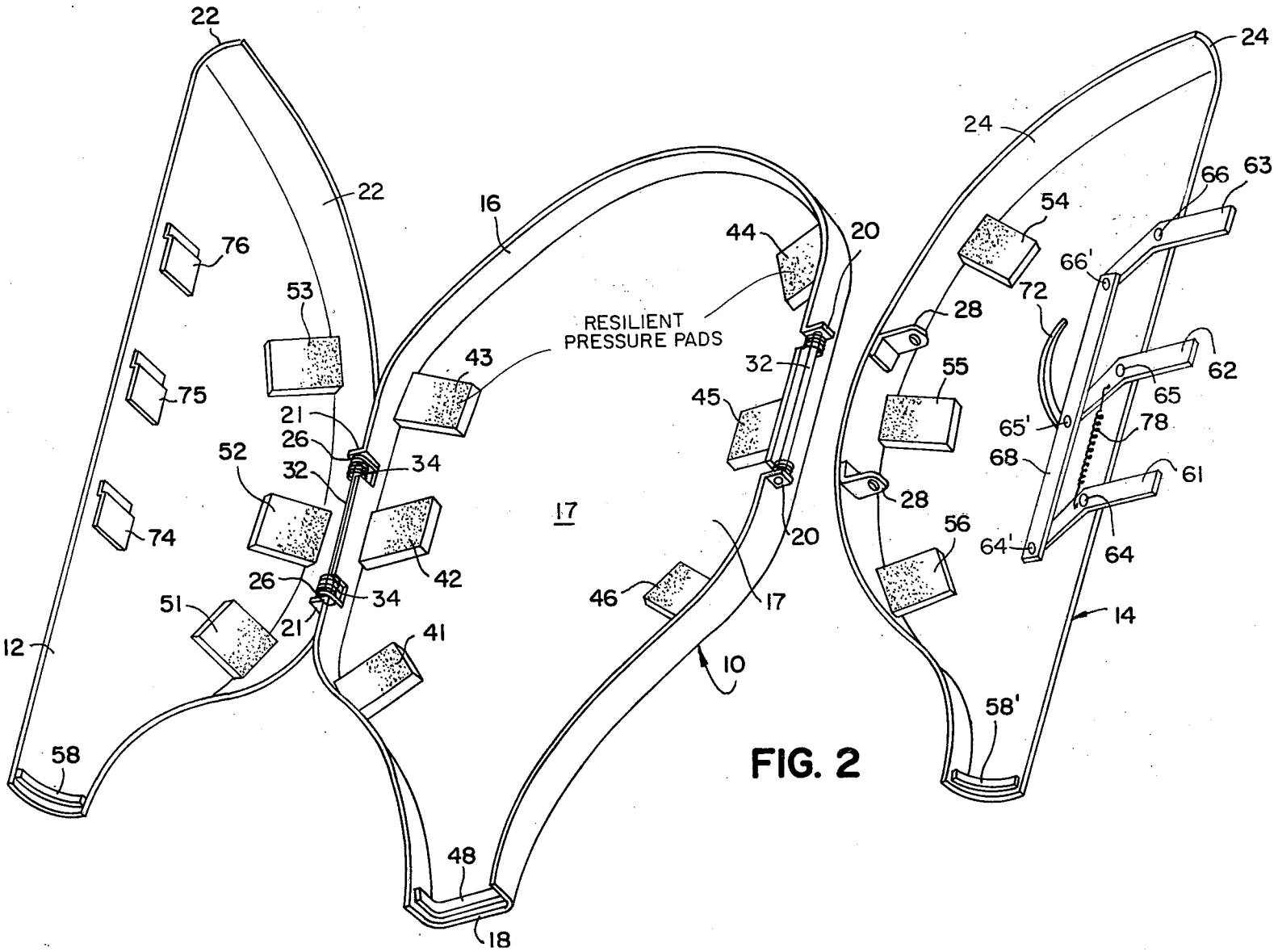
FIG. 2 is a perspective, partly exploded, view showing the case and press in an open position.

Referring to FIGS. 1 and 2, the tennis racket case and press in accordance with the invention comprises a bottom frame portion 10 and a pair of top half frame portions 12 and 14 shaped to contain the head of a tennis racket when in closed position, which is shown in FIG. 1. The frame portions 10, 12 and 14 are made of a plastic, a thin lightweight metal, or other suitable material, which provides stiffness to protect the tennis racket against physical damage. The interior of the frame portions 10, 12 and 14 is covered with a liner 15 (shown in FIG. 4, and omitted from the other Figures for clarity), a weatherized padded fabric, such as padded vinyl, to protect the racket against minor scratches or the like.

The bottom frame portion 10 has a side wall 16 extending around the periphery thereof except for an open throat portion 18 at one end thereof. The side wall 16 extends upwardly from the flat back 17 of frame portion 10 and is provided with two pairs of hinge brackets 20 and 21, located at opposite portions of the frame portion 10 and projecting outwardly from the side wall 16 as shown in FIG. 2.

The top half frame portions 12 and 14 cooperate to enclose the bottom frame portion 10, and together are slightly larger than this bottom frame portion. Downwardly extending side walls 22 and 24 extend from top frame portions 12, 14, around the periphery of the side wall 16 of the bottom frame portion 10 as is best shown in FIG. 1.

Figure 5:
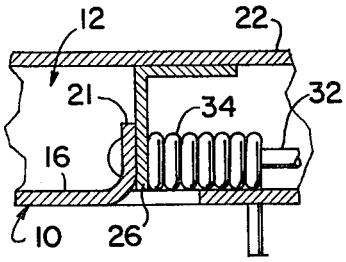
FIG. 5 is an enlarged fragmentary view of in section with case closed of the upper left hinge area of FIG. 3, taken as indicated by the lines and arrows 5—5 in FIG. 4.

The top half frame portions 12 and 14 are provided with pairs of hinge brackets 26 and 28, respectively. Two hinge means are provided to hingedly connect top hinge brackets 26 and 28 of top half frame portions 12 and 14 onto the hinge brackets 21 and 20 of the bottom frame portion 10, each of such hinge means comprising a hinge pin 32 and a pair of coil springs 34. A hinge pin 32 extends through holes in the associated hinge brackets 20, 28 to pivotally connect the top half frame portion 14 onto the side wall 16 of bottom portion 10, and another hinge pin 32 extends through holes in hinge brackets 21, 26 to connect top half frame portion 12 to bottom side wall 16, as shown in greater detail in FIG. 5. Each pair of springs 34 associated with a hinge pin 32 is wound in a coiled condition and has one end positioned to engage the outside of side wall 16 of the bottom frame portion 10 and its other end in engagement with the interior of the associated top side walls 22 and 24. By this arrangement, the coiled springs 34 bias the top half frame portions 12 and 14 toward their open position. These frame portions 12 and 14 are, of course, movable against the bias of the springs 34 to the closed position shown in FIG. 1 where they are latched by a suitable latching means to be described hereafter.

Figure 3:
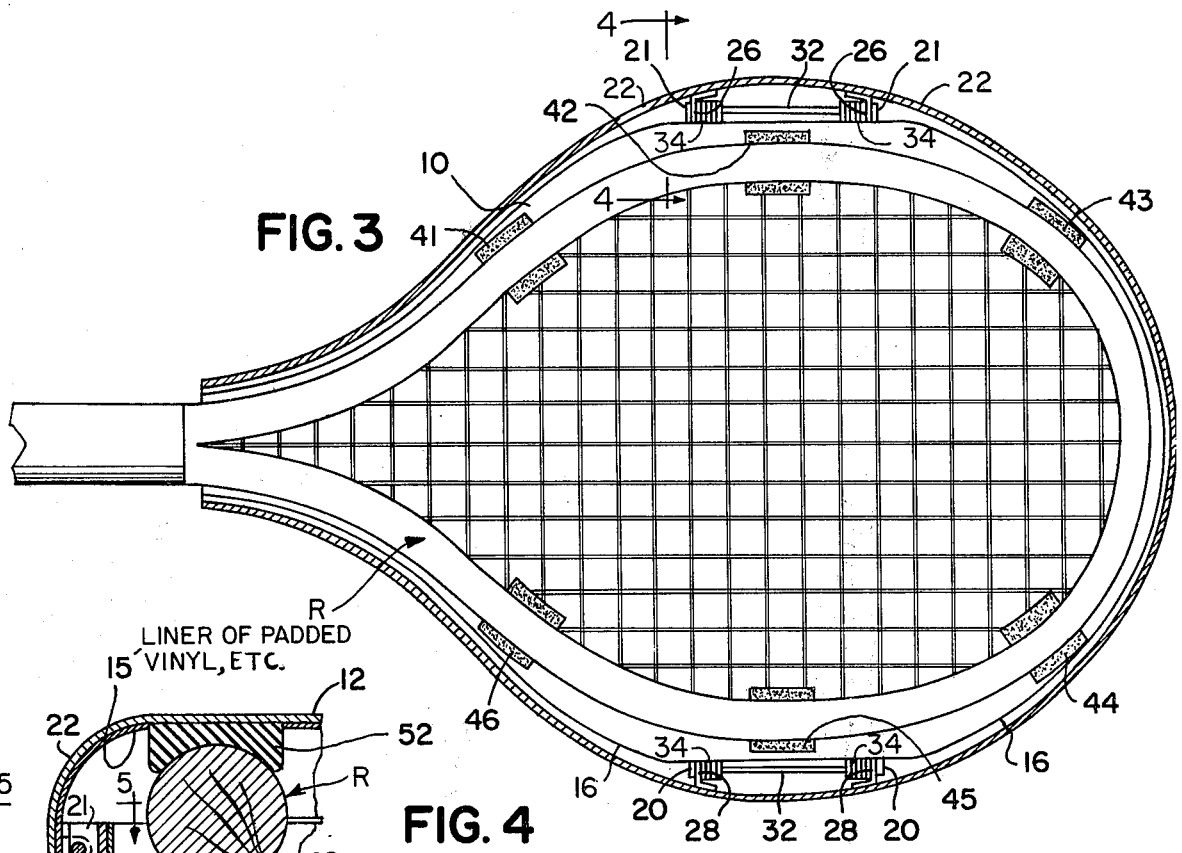
FIG. 3 is a top plan view showing a portion of the case and press with the top frame portion in section to show a racket positioned therein.

Means are provided for supporting a racket ("R" in FIG. 3) within the frame portions 10, 12 and 14 in a manner to provide a cushion support for the racket. To this end, there are provided six rubber pads 41 to 46 on the flat back of the bottom frame portion 10 at spaced locations around the periphery thereof so as to be contacted by the head portion of a tennis racket positioned therein. Top half frame portion 12 is provided with three rubber pads 51, 52 and 53 arranged in opposed relation with the rubber pads 44, 45 and 46 on the bottom frame portion as is apparent from a consideration of FIG. 2. The placement of the rubber pads is such as to provide pressure points on both the bottom and top of the case so that the racket is held between pairs of these pressure pads when the case is in the closed position. In addition, there is provided a rubber pad 48 near the throat 18 of the bottom frame portion and a pair of rubber pads 58 and 58' on the top half frame portions 12 and 14. The pads 48, 58 and 58' are arranged to contact the neck of the racket when it is contained in closed case so as to stabilize the racket at the neck thereof and to exert an equating pressure on the entire frame head.

Means are provided for locking the top half frame portions 12 and 14 in the closed position shown in FIG. 1. To this end, there is provided a latch means comprising three arms 61, 62 and 63 pivotally mounted at pivots 64, 65 and 66, respectively, on the flat back of top half frame portion 14 as is shown in FIG. 2. A link 68 pivotally interconnects the three arms 61, 62 and 63 at 64', 65' and 66', respectively, for conjoint movement therewith. A knob 70 is mounted on the link 68 and projects through an arcuate slot 72 in the frame portion 14 for access from the exterior as is shown in FIG. 1. By this arrangement, the movement of the knob 70 between opposite ends of the arcuate slot 72 causes pivotal movement of the arms 61, 62 and 63 between a locking position and an unlocking position. In the unlocking position, the free ends of the members 61, 62 and 63 are clear of three latch members 74, 75 and 76 mounted on the frame portion 12. In the locking position thereof, the members 61, 62 and 63 move into engagement with latch members 74, 75 and 76, respectively. A spring 78 is connected in tension between arm 62 and pivot 64 so as to bias the linked arms toward their closed position.

When it is desired to place a tennis racket in the tennis racket cover and support press in accordance with the invention, the knob 70 is moved to the unlocking position clearing the free ends of arms 61, 62 and 63 from the latch members 74, 75 and 76 whereupon the springs 34 urge the top half frame portions 12 and 14 to their open position. The racket is then placed onto the rubber pads 41–46 in the bottom frame portion 10 as well as onto the rubber pad 48, this position being illustrated in FIG. 3. The top half frame portions 12 and 14 are then pivoted to the closed position shown in FIG. 1 and the knob 70 is moved along arcuate slot 72 to position the latch in the closed position in which arms 61, 62 and 63 move into engagement with latch brackets 74, 75 and 76, respectively. The racket is now held in the manner shown in FIG. 4, between the six pairs of pressure pads, namely 41 and 51; 42 and 52; 43 and 53; 44 and 54; 45 and 55; and 46 and 56. Also, the neck portion of the racket is held between rubber cushion 48 and the opposed rubber cushions 58 and 58'. Accordingly, the racket frame is held securely and firmly and is maintained under a pressure condition to prevent warping.

When it is desired to use the racket, the latch mechanism is opened by movement of the knob 70 to the open position in slot 72 whereupon the top half frame portions 12 and 14 automatically pivot to the open position thereby permitting easy removal of the racket.

It will be apparent that when the racket is contained within the combination cover and press, it is protected against physical or other damage and at the same time is maintained in a pressed condition to prevent warpage. Moreover, when it is desired to use the racket, the press can be opened easily.

The inventive combination cover and press has many advantages over prior art devices. It is an efficient, single-unit item requiring no accessory parts for its operation. No elaborate application of thumb screws, springs, clamps, wedges or other devices is required to have the invention function as a racket press. The inventive device is smoothly rounded on its edges and sides and flat on both top and bottom; nothing protrudes beyond its cover and frame. Its uncomplicated construction makes it easy to use. The use of the two top cover sections as effective levers, hinged to the rigid bottom frame, positively presses the racket between the sets of rubber retainers to provide a superior racket press. The latch, which will not open accidentally or while the latch system is acting to secure the covers, provides the necessary pressure to the press. The bottom full frame effectively prevents racket warp in a manner not available in prior art devices of this nature. The sleek, smoothly designed appearance in no way compromises the invention's use as a press, cover and protector. In spite of the multiple jobs it accomplishes, the inventive device is light and easy to carry. Its rigidity protects the stringed surface from puncture or breakage, yet its soft interior protects the racket and its finish. The inventive device is integrally formed and requires no assembly technique for each use. The user of the inventive device merely opens the top covers, places the racket inside on the rubber retainers on the bottom frame, and closes and latches the top covers over the racket, assured that his racket has maximum protection in all respects.

It is to be understood that the invention is not to be limited to the scope of the specific form thereof herein shown and described and that various embodiments thereof may be employed within the scope of the claims set forth hereinafter.

We claim:

1. A combination protective cover and support press for tennis rackets or the like comprising a bottom frame portion having a substantially oval shape with a throat at one end with an upstanding wall except at the end of said throat and being adapted to receive the head of a tennis racket, a pair of top half frame portions, hinge means connecting said pair of top frame portions to said bottom frame portion for movement between a closed position overlying said bottom frame portion and an open position exposing said bottom frame portion to permit the insertion of a tennis racket or the like therein and having a substantially half-oval shape with a throat at one end and with an upstanding wall except at the end of said throat and being adapted to contain the head of a tennis racket or the like when said top half frame portions are in said closed position to thereby protect the tennis racket, all of said frame portions being made of a lightweight stiff material, the outer and inner wall surfaces of said top and bottom frames portions being smooth, continuous surfaces unmarred by indentations, resilient means mounted on said inner wall surfaces of said top and bottom frame portions in paired opposed relationship and adapted to exert opposing forces on the frame of a tennis racket positioned therebetween, and means for locking the top half frame portions in closed position, said resilient means including a plurality of resilient pressure pads mounted on said bottom frame portion in spaced-apart relationship near its periphery and on said top half frame portions in an arrangement such that corresponding bottom and top frame pads oppose each other, said pressure pads being distinct entities from said top and bottom frame portions and extending and projecting from their associated frame portions, whereby opposing pads apply a pressing force against each side of the frame of a tennis racket or the like when placed therein to thereby restrict warping.

2. A combination cover and press according to claim 1 including at least six pairs of opposed pads in spaced relation whereby to contact the frame of the tennis racket or the like at circumferentially spaced locations.

3. A combination cover and press according to claim 1 including spring means connected to said hinge means for biasing said top half frame portions toward said open position thereof.

4. A combination cover and press according to claim 1 wherein said locking means includes at least one arm pivotally mounted on the inner wall surface of one top half frame portion and extending under the inner wall surface of the other top half frame portion when the top portions are closed, and latch means for receiving said arm mounted on the inner wall surface of the other top half frame portion when the top frame portions are closed, spring means connected to said at least one arm for biasing it to a locking position, and actuating means extending from said locking means outwardly of said outer wall surface for moving said arm into and out of engagement with said latch means from the outside of the combination cover and press.

5. A combination protective cover and support press for tennis rackets or the like comprising a bottom frame portion having a substantially oval shape with a throat at one end with an upstanding wall except at the end of said throat being adapted to receive the head of a tennis racket, a pair of top half frame portions, hinge means connecting said pair of top frame portions to said bottom frame portion for movement between a closed position overlying said bottom frame portion and an open position exposing said bottom frame portion to permit the insertion of a tennis racket or the like therein and having a substantially half-oval shape with a throat at one end and with an upstanding wall except at the end of said throat and being adapted to contain the head of a tennis racket or the like when said top half frame portions are in said closed position to thereby protect the tennis racket, all of said frame portions being made of a lightweight stiff material, the outer and inner wall surfaces of said top and bottom frames portions being smooth, continuous surfaces unmarred by indentations, resilient means mounted on said inner wall surfaces of said top and bottom frame portions in paired opposed relationship and adapted to exert opposing forces on the frame of a tennis racket positioned therebetween, and means for locking the top half frame portions in closed position, said resilient means including a plurality of resilient pressure pads mounted on the bottom frame portion in spaced-apart relationship near its periphery and on the top half frame portions in an arrangement such that corresponding bottom and top frame pads oppose each other, whereby opposing pads apply a pressing force against each side of the frame of a tennis racket or the like when placed there to restrict warping, spring means connected to the hinge means for biasing the top frame portions to open position, said locking means including three locking arms pivotally mounted on the inner wall surface of one top half frame portion and extending under the inner wall surface of the other top frame portion when the top frame portions are closed, link means pivotally connected to the three arms for conjoint movement therewith, three latch members mounted on the inner wall surface of said other top half frame portion and adapted to receive the three locking arms to lock the top frame portions together, spring means connected between one of the locking arms and a pivot of another locking arm biasing the arms to locking position, a knob mounted on said link means and projecting through an arcuate slot in the top frame portion and accessible from the exterior of the cover and press for actuating the locking arms into and out of engagement with the latch members.

* * * * *